United States Patent [19]

Ramer

[11] 3,945,134

[45] Mar. 23, 1976

[54] SKI BOOT

[75] Inventor: Paul C. Ramer, Golden, Colo.

[73] Assignee: Alpine Research, Inc., Golden, Colo.

[22] Filed: Sept. 13, 1974

[21] Appl. No.: 505,632

[52] U.S. Cl. ..... 36/2.5 AL
[51] Int. Cl.[2] ..... A43B 00/00
[58] Field of Search ..... 36/2.5 R, 2.5 AL

[56] References Cited

UNITED STATES PATENTS

| | | | |
|---|---|---|---|
| 3,067,531 | 12/1962 | Scott et al. | 36/2.5 AL |
| 3,619,914 | 11/1971 | Hanson et al. | 36/2.5 AL |
| 3,686,778 | 8/1972 | Hornung | 36/2.5 AL |
| 3,694,940 | 10/1972 | Stohr | 36/2.5 AL |
| 3,807,062 | 4/1974 | Spier | 36/2.5 AL |

*Primary Examiner*—Patrick D. Lawson
*Attorney, Agent, or Firm*—Burton, Crandell & Polumbus

[57] ABSTRACT

A ski boot includes a foot portion and a leg portion extending upwardly along the calf of the leg from the foot portion and being pivotally connected to the foot portion for movement about a generally horizontal axis extending transversely of the boot. The pivotal connection of the leg portion to the foot portion is selectively adjustable to allow vertical sliding movement of the leg portion relative to the foot portion whereby the leg portion can be inclined laterally relative to the foot portion. A connection unit interconnecting the foot portion to the leg portion along a rear portion of the boot includes double acting resilient means for cushioning both forward and rearward pivotal movement of the leg portion relative to the foot portion. The connection unit is connected to the boot by quick release means whereby the unit can be quickly removed allowing free pivotal movement of the leg portion relative to the foot portion if desired. An insulated sock member adapted to be slipped over the foot of the user is removably insertable into the boot and includes a core layer of a soft, resilient, permeable material which cushions the user's foot and lower leg from the relatively rigid boot, insulates the foot and lower leg of the user from cold ambient temperatures, and also provides ventillation for removing water vapor.

19 Claims, 12 Drawing Figures

SKI BOOT

BACKGROUND OF THE INVENTION

The present invention relates generally to footwear and more particularly to a pivotal ski boot designed for use in both alpine and cross-country skiing.

Ski boots have developed from a rather low topped leather boot allowing a limited degree of ankle movement to a more rigid plastic shelled boot which has substantially eliminated all ankle movement thereby establishing better control of the ski by rendering the ski a substantially integral part of the lower leg of the user. These rigid plastic boots, while providing for more positive control of the ski, have made it very difficult to walk either with or without the ski connected thereto since the ankle joint is completely immobilized.

To facilitate walking, pivotal ski boots have been developed whereby an upper section of the boot is pivotally connected to a lower section about a pivot axis extending transversely of the boot through the ankle joint. The upper sections of these boots have been connected to the lower sections with numerous devices for limiting pivotal movement between the sections, but these devices, to date, have been aesthetically displeasing and are not readily removable from the boot so that complete pivotal freedom of the upper section relative to the lower section cannot be obtained and the full weight of the boot including the connecting means must be carried with the boot even while walking or touring.

Further, conventional and pivotal ski boots have not allowed for lateral bending or movement of the upper portion relative to the lower portion so that walking over uneven terrain has been extremely difficult and is tiring for the user of the boot over long distances.

OBJECTS OF THE INVENTION

It is an object of the present invention to provide a new and improved ski boot adapted for use in both alpine skiing and touring.

It is another object of the present invention to provide a ski boot having upper and lower pivotally connected portions with resilient means also connecting the upper and lower portions for cushioning both forward and rearward pivotal movement of the upper portion relative to the lower portion.

It is another object of the present invention to provide a ski boot having upper and lower pivotal portions pivotally connected for movement about a generally horizontal transverse axis and wherein the upper section is allowed to incline laterally relative to the lower section.

It is another object of the present invention to provide a new and improved ski boot having a removable sock portion with a soft, resilient, permeable core for insulation and ventillation purposes and to cushion the foot and lower leg portion of a user from the relatively hard surrounding shell of the boot.

It is another object of the present invention to provide a ski boot having upper and lower portions which are pivotally connected for movement about a generally horizontal transverse axis and having a connection unit which yieldingly resists pivotal motion of the upper portion relative to the lower portion but which can be quickly removed from the boot to allow free pivoting movement of the upper portion relative to the lower portion.

SUMMARY OF THE INVENTION

The ski boot of the present invention has been designed to accommodate both alpine and touring skiers with a comfortable boot which provides optimum control of the ski during alpine skiing and adequate freedom of movement of the ankle joint during touring skiing or walking without skis attached to the boot.

The boot includes a lower foot encasing portion and an upper leg encasing portion which is pivotally connected to the foot portion for movement about a generally horizontal transverse axis. A connection unit interconnects the leg and foot portions of the boot to yieldingly resist pivotal movement in both a forward and rearward direction. The connection unit is quickly removable from the boot to allow free pivotal movement of the leg portion relative to the foot portion as is desired while touring or walking. When the connection unit is attached to the boot, however, the leg portion and the foot portion cooperate in transferring motion of the skiers knees to the skis for optimum control of the ski during alpine skiing.

The pivotal connection of the leg portion to the foot portion of the boot is uniquely designed to selectively allow vertical sliding movement of the leg portion relative to the foot portion so that the leg portion can be inclined laterally of the foot portion for comfort when walking with the boot over uneven terrain.

It will be appreciated with the detailed description later that the boot is ideally suited for use by so-called alpine-touring skiers who travel across hilly terrain by climbing slopes, skiing down slopes and traversing relatively level areas since the boot can be quickly converted from a relatively rigid boot with the connection unit affixed thereto for use in alpine skiing to a freely pivotal boot with the connection unit removed for use in cross-country or touring skiing. Further, if terrain is encountered where it is more feasible to walk than to ski, the skis can be removed from the boot along with the connection unit and the pivotal joint between the leg portion and foot portion of the boot adjusted to allow for lateral movement of the leg portion relative to the foot portion so that the user can comfortably walk over uneven terrain.

BRIEF DESCIPTION OF THE DRAWINGS

DESCRIPTION OF THE PREFERRED EMBODIMENTS

Figure 1:
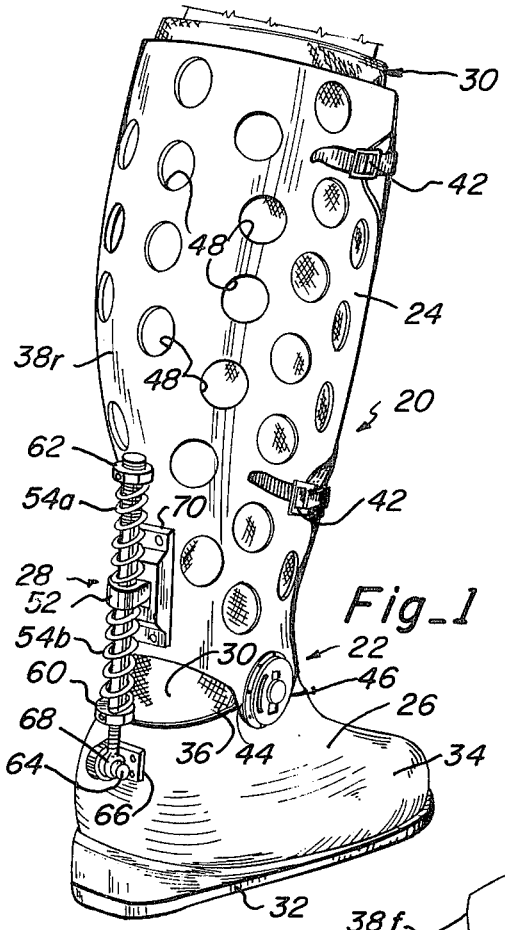
FIG. 1 is a perspective view of the ski boot of the present invention.
Figure 2:
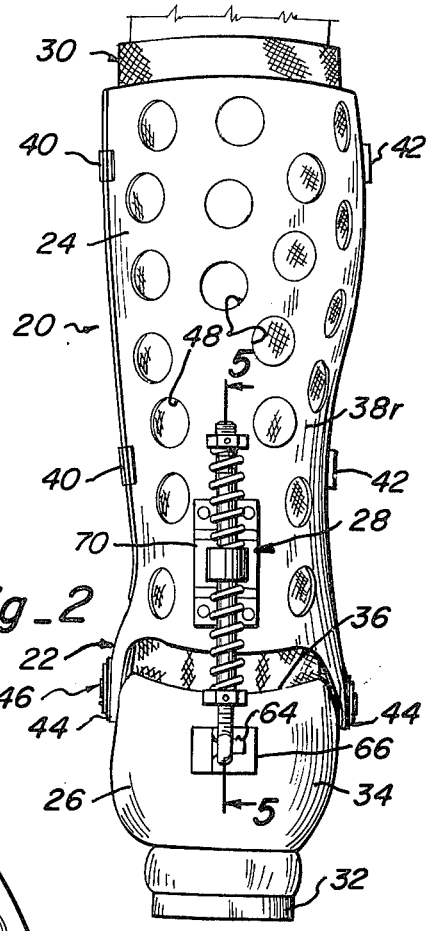
FIG. 2 is a rear elevation of the ski boot of FIG. 1.

Referring first to FIG. 1, the ski boot 20 of the present invention is shown to include an outer shell 22 having an upper leg portion 24 and a lower foot portion 26, a connection unit 28 interconnecting the leg portion to the foot portion and an insulated sock 30 which is removably received within the outer shell 22.

The foot portion 26 includes a sole 32 and an upper 34 which are integrally connected and preferably made of a moldable somewhat rigid plastic material to conform to the general configuration of a foot and to have the appropriate formations for attaching the boot 20 to a ski by a conventional binding. The top of the upper 34 is low compared to present day plastic ski boots and preferably terminates at about the level of the ankle bone of a user. The upper of the boot is open only at the upper edge 36 thereof so that the foot can be inserted into the upper through the open upper edge.

The leg portion 24 of the boot 20 consists of two generally semi-cylindrical elements 38*f* and 38*r* which are connected along one edge by hinges 40 and which have fasteners 42 along the opposite edge, which in the disclosed form are of the buckle type. The two generally semi-cylindrical elements of the leg portion are disposed so that one forms a rear element 38*r* and the other a front element 38*f* and the rear element has a pair of depending ears 44 which extend downwardly along the outside of the upper 34 of the foot portion 26 where pivot members 46 interconnect the leg portion to the foot portion. The pivot members, which will be described in more detail later, provide for pivotal movement of the leg portion relative to the foot portion about a generally horizontal axis extending transversely of the boot and further allow the leg portion to be inclined laterally of the foot portion to a limited degree.

Figure 3:
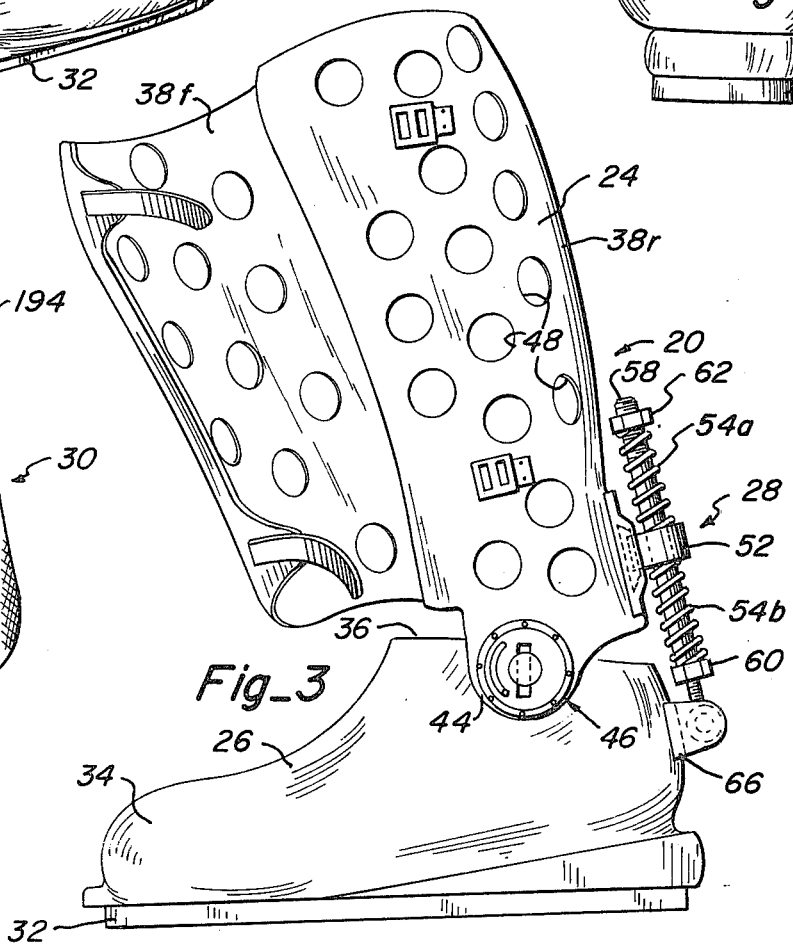
FIG. 3 is a side elevation of the boot of FIG. 1 with the leg portion of the boot in an open condition.

It will be appreciated in FIG. 3, that the front element 38*f* of the leg portion 24 can be swung to an open position, FIG. 3, so that the user of the boot can insert his foot and leg through this open front to position the boot on his foot. The leg portion 24 preferably extends over halfway up the calf portion of the user's leg so that the leg serves as a lever in transmitting knee movement to a ski when the boot is conventionally mounted upon a ski. Preferably, the leg portion of the boot is also made of a somewhat rigid plastic material having very slight flexibility and fits snugly around the sock portion 30 of the boot to establish a frictional grip on the leg of the user to retain the foot of the user in the foot portion 26 of the boot. In the disclosed form, ventilation openings 48 are provided in the leg portion 24 for optimum comfort.

The connection unit 28 is adapted to resist both forward and rearward pivotal movement of the leg portion 24 of the boot relative to the foot portion 26. In the preferred form shown in FIGS. 1 through 3 and 5, the connection unit 28 includes a slide rod assembly 50, a guide sleeve 52, and a pair of compression springs 54*a* and 54*b* concentrically mounted upon the slide rod assembly on opposite sides of the guide sleeve. The slide rod assembly 50 has an eyelet bolt 56 threaded into one end of an elongated collar 58 which has an annular shoulder 60 at the one end adapted to seat one of the compression springs 54*b*. The opposite end of the collar 58 is externally threaded to receive an adjustment nut 62 which retains the other spring 54*a* on the collar. The eyelet on the bolt 56 is pivotally received on a pin 64 which extends transversely of the boot 20 and is mounted upon a mounting bracket 66 anchored to the back of the foot portion 26 of the boot. The pin 64 has a conventional ball detent 68 thereon which is adapted to releasably retain the eyelet portion of the bolt 56 on the pin in a manner such that it can be quickly removed from the pin when desired.

Figure 5:
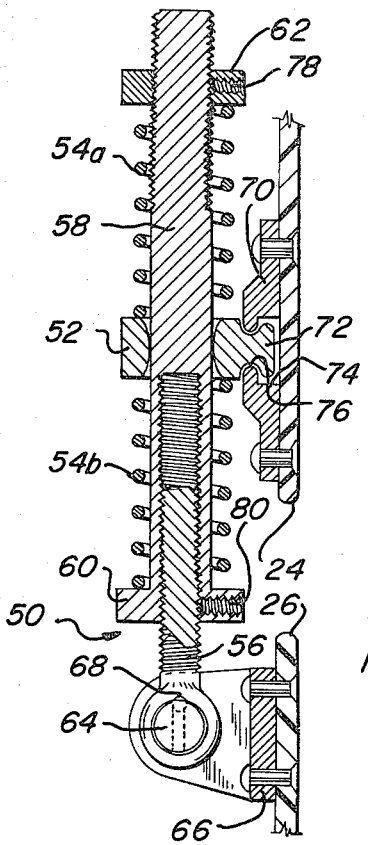
FIG. 5 is a vertical section taken along line 55 of FIG. 2 of the connection unit used on the boot of FIG. 1.

The guide sleeve 52 is releasably mounted on a second bracket 70 which is anchored to the rear portion of the leg portion 24 of the boot and has a T-Shaped protrusion 72 extending in parallel relationship to the cylindrical passage through the sleeve 52 so that when the passage is vertically oriented, as shown in FIG. 5, the T-shaped protrusion 72 will be retained in a pocket 74 in the bracket 70 which opens through a horizontal slot 76 by rotating the sleeve 52 through a ninety degree angle, the T-shaped protrusion 72 will align with the slot 76 allowing the sleeve to be quickly removed from the bracket.

The adjustability of the nut 62 allows for precompression of the springs 54*a* and 54*b* for control of the desired resistance which the springs will have to pivotal movement of the leg portion of the boot relative to the foot portion. The nut 62 has a set screw 78 so that its position can be selectively fixed, and similarly, a set screw 80 in the shoulder 60 serves to fix the position of the eyelet ball 56 relative to the collar 58. The compression springs 54*a* and 54*b* accordingly abut the guide sleeve at one end and the adjustment nut 62 and shoulder 60 respectively at the opposite ends whereby pivotal movement of the leg portion of the boot in either a forward or rearward direction will compress one or the other of the compression springs via the guide sleeve so that the springs yieldingly resist pivotal movement of the leg portion relative to the foot portion and thereby buffer sudden movements of the leg portion to the foot portion such as may be imparted when a skier encounters bumps or sudden changes in snow conditions in a ski run. It should be appreciated that the connection unit 28 can be quickly removed from the boot merely by snapping the eyelet bolts 56 off the pin 64 on the foot portion of the boot and subsequently rotating the guide sleeve 52 so that its T-shaped extension 72 can be removed from the bracket 70 on the leg portion of the boot. Once the connection unit has been removed from the boot, the legf portion is freely pivotal about a generally horizontal transversely extending axis extending through the pivot member 46 so that the user of the boot can walk freely or can easily traverse relatively horizontal surfaces with his skis on as is typical of cross country skiing or touring. It should be appreciated that if complete freedom of pivotal movement was not desired for cross country skiing, yet the connection unit used in alpine skiing made the boot too rigid, lighter springs could be incorporated into a connection unit which would not have as great a resistance to the pivotal movement as the springs used in the unit for alpine skiing.

Figure 7:
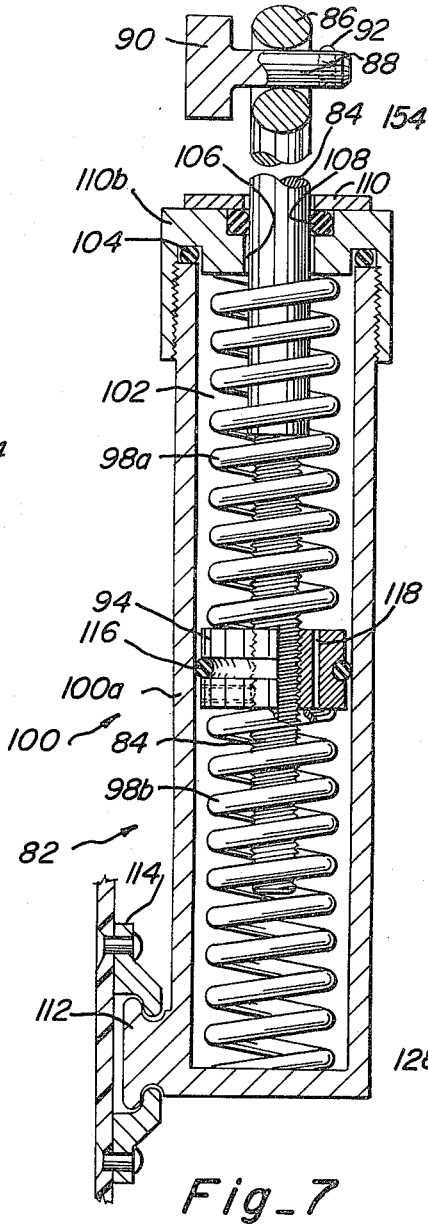
FIG. 7 is an enlarged fragmentary vertical section taken through a second embodiment of the connection unit used on the boot of FIG. 1.
Figure 8:
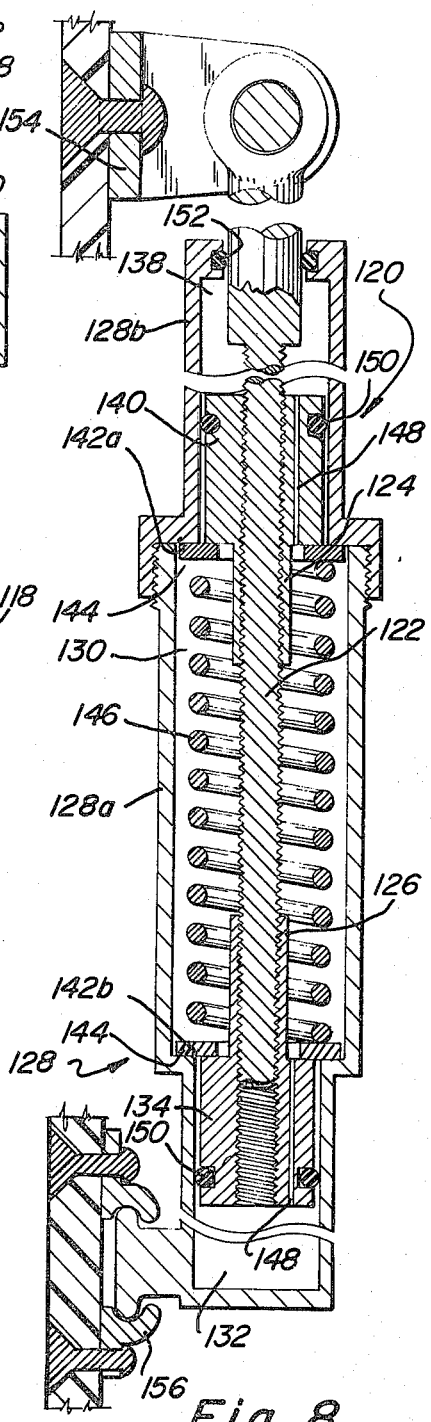
FIG. 8 is an enlarged fragmentary vertical section of still another embodiment of the connection unit used on the boot of FIG. 1.

The connection unit could take other forms such as shown in FIGS. 7 and 8 to accomplish the same results. Looking at the embodiment shown in FIG. 7, it can be seen that the connection unit 82 includes a slide rod 84 having an eyelet 86 at its upper end which is releasably connected to a pin 88 extending transversely of the boot and anchored to a bracket 90 which is affixed to the rear of the leg portion 24 of the boot. As in the previously described embodiment, the pin 88 has a ball detent 92 thereon so that the rod can be quickly removed from or secured to the pin. The rod 84 carries a collar 94 which is selectively fixed at any desired location along the length of the rod by a set screw 96. The collar 94 separates a pair of compression springs 98*a* and 98*b* which are concentrically mounted upon the rod and retained in position by an outer housing 100 having an elongated cylindrically shaped body 100*a* and a cap 100*b* threadably received on the open upper end of the body 100*a*. The cap and body define an air-tight chamber 102 and an O-ring 104 is provided at the interconnection of the housing parts to provide a positive hermetic seal. The cap 100b has a vertical passage 106 therethrough which slidably receives the slide rod 84 and a second O-ring 108 is provided in an annular recess in the upper end of the cap to establish a sliding hermetic seal between the housing and the slide rod. The upper end of the cap has a retaining plate 110 thereon which holds the O-ring 108 in its seated position within the annular recess.

The lower end of the housing 100 is connected to the foot portion 26 of the boot by a T-shaped connector 112 which cooperates with a slotted bracket 114 in removably connecting the housing to the foot portion of the boot. As in the previously described embodiment, rotation of the T-shaped connector 112 relative to the bracket 114 on the foot portion allows the T-shaped connector to be removed from the boot so that the housing itself can be removed. The collar 94 on the slide rod 84 has an annular groove setting a third O-ring 116 which is adapted to slide against the internal cylindrical wall of the body portion 100a of the housing establishing a hermetic seal between upper and lower portions of the internal chamber of the housing. The collar 94 has an axially extending fluid flow passage 118 therethrough allowing air or another desired fluid retained in the chamber to flow from one end of the chamber to the other as the collar is slid axially of the chamber with sliding movement of the slide rod. It will, therefore, be appreciated that in addition to the yielding resistance supplied by the compression springs 98*a* and 98*b* to pivotal movement of the leg portion 24 relative to the foot portion 26, the enclosed hermetically sealed chamber 102 in cooperation with the collar 94 establishes a dampening effect to prevent a sudden return of the collar to its centered position and consequently prevents a sudden return of the leg portion of the boot to its normal position relative to the foot portion. Accordingly, after a skier has traversed a large bump or mogul wherein the leg portion of the boot was forced to pivot relative to the foot portion, the ski will not slap back down against the ground but will rather return at a retarded speed enabling the skier to more smoothly pass through heavily moguled areas on a ski slope.

Referring to FIG. 8, another embodiment of the connection unit is shown. The connection unit 120 shown in FIG. 8 included a threaded slide rod 122 having axially adjustable internally threaded collars 124 and 126 disposed thereon in axially spaced relationship. The slide rod 122 is maintained in a housing 128 which includes a threaded slide rod 122 having axially adjustable internally threaded collars 124 and 126 disposed thereon in axially spaced relationship. The slide rod 122 is maintained in a housing 128 which includes a lower body member 128*a* and an upper cap 128*b* with the cap threadedly received on the upper end of the body member. The body member 128*a* has two coaxial cylindrical chambers 130 and 132 with the lower chamber 132 being of a smaller diameter than the upper chamber 130 and adapted to slidably receive an enlarged cylindrical head 134 at the lower end of the lower threaded collar 126. The cap portion 128*b* of the housing has a cylindrical chamber 138 therein substantially conforming in size and configuration to that of the chamber 132 in the body so as to slidably receive an enlarged head 140 on the upper end of the upper collar 124. Abutment shoulders 142*a* and 142*b* are defined between the two chambers slidably receiving the heads 134 and 140 on the collar and the larger chamber 130 in the body member. A pair of washer members 144 are biased against the shoulders 142*a* and 142*b* by a coil spring 146 coaxially mounted upon the slide rod 122. It will, therefore, be appreciated that sliding movement of the slide rod in either axial direction will cause the head on one of the collars to engage the adjacent washer 144 and effect a compression of the spring 146 which will yieldingly resist movement of the slide rod in that direction. Each collar 124 and 126 has a fluid flow passage 148 therethrough and has an annular recess in its outer surface to receive a sealing O-ring 150 which establishes a hermetic seal between the associated collar and the adjacent cylindrical wall of the housing. In this manner, as with the embodiment shown in FIG. 7, when air or another fluid is retained in the housing, a fluid buffering affect is obtained to damp sudden axial movement of the slide rod relative to the housing. The cap member 128*b* of the body also has an annular recess around the opening therein receiving an O-ring 152 to establish an hermetic seal with the slide rod. The slide rod, as in the embodiment described in FIG. 7, is anchored to the leg portion 24 of the boot as by a bracket 154 and the housing is anchored to the back portion of the foot portion of the boot as by a bracket 156, each of these brackets being identical to the corresponding brackets in the embodiment of FIG. 7.

Figure 9:
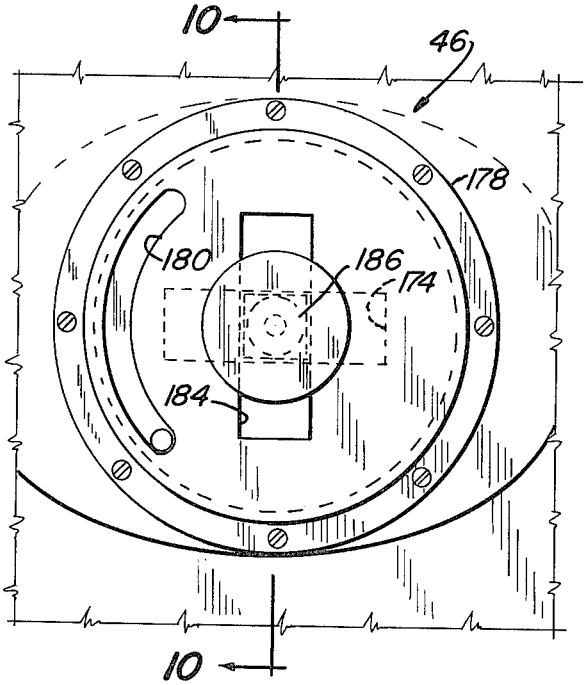
FIG. 9 is an enlarged fragmentary side elevation of the pivot member used on the boot of FIG. 1.
Figure 10:
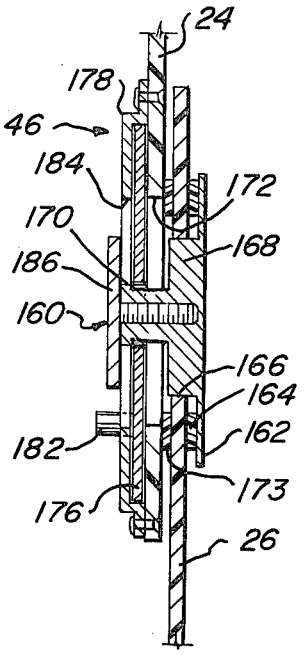
FIG. 10 is a section taken along line 10–10 of FIG. 9.
Figure 11:
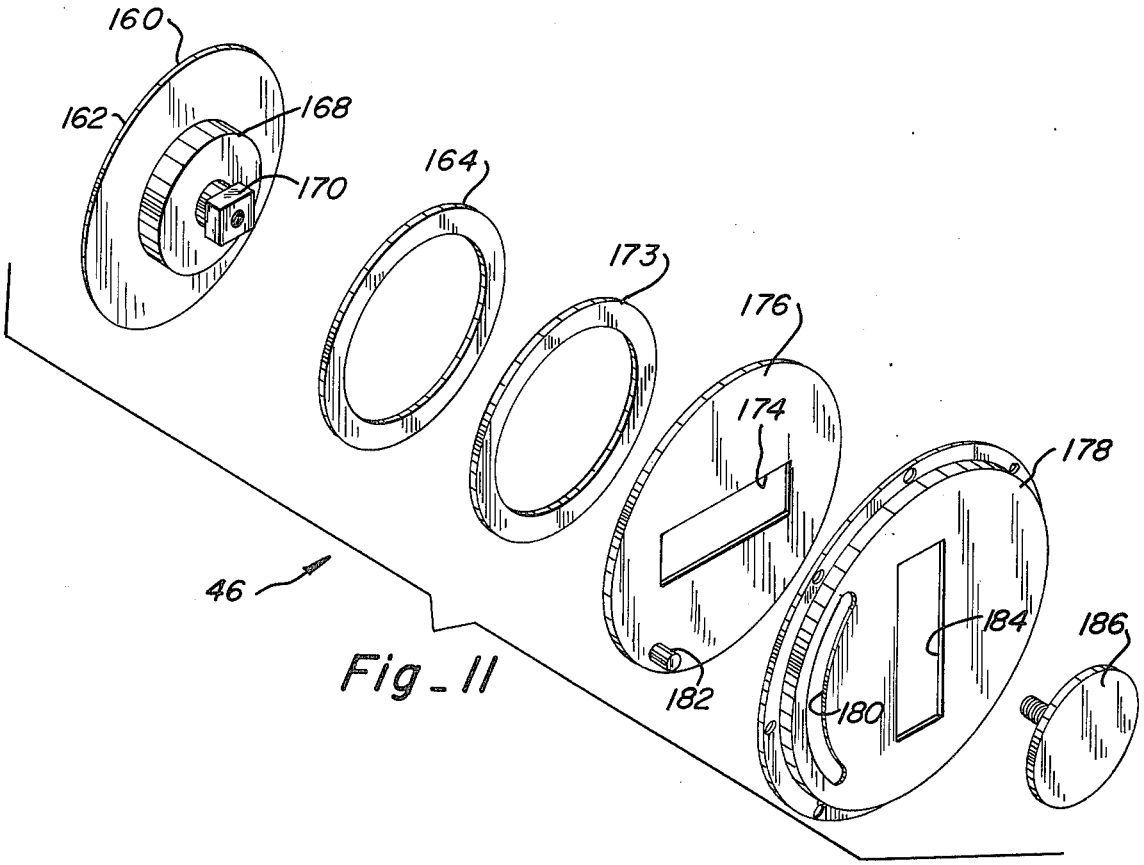
FIG. 11 is an exploded perspective view of the pivot member shown in FIG. 9.

Looking now at FIGS. 9 through 11, the pivot member 46 interconnecting the leg portion 24 and the foot portion 26 of the boot 20 at the opposite sides thereof is shown in detail. The pivot member can be seen to have a pivot pin 160 having a circular flange 162 adapted to ride against a circular low friction washer 164, such as of teflon, anchored to the inner wall of the foot portion 26 of the boot in circumferential relationship with a circular opening 166 through the side of the foot portion. Immediately outside the circular flange, is a first coaxial cylindrical body portion 168 of the pin 160 which is received within the circular opening 166 through the side of the foot portion. Immediately outside the circular flange, is a first coaxial cylindrical body portion 168 of the pin 160 which is received within the circular opening 166 in the foot portion so as to be rotatable therewithin. Projecting coaxially outwardly from the first body portion 168 is a second body portion 170 of the pin which is of reduced diameter relative to the first body portion and has a circular cross section adjacent the first body portion and a square cross section at the outer end thereof. The portion of the second body portion which is of circular cross section extends through a generally vertical slot 172 in the depending ear 44 of the leg portion 24 of the boot with the slot 172 being of rectangular configuration. The ear 44 is spaced from the foot portion 26 by low friction washer 173. The circular cross sectional portion of the second body portion 170 also extends through a rectangularly shaped slot 174 in a rotary plate 176 which can be either aligned or nonaligned with the slot 172 in the leg portion as may be desired for purposes to be explained hereinafter. The rotary plate 176 is supported by a generally circular cover plate 178 which is anchored to the outer surface of the leg portion 24 in concentric relationship with the pivot pin 160 and which defines a space between itself and the leg portion of the boot in which the rotary plate is free to rotate. The cover plate 178 has an arcuate slot 180 therein which slideably receives an adjustment pin 182 anchored to the rotary plate and projecting outwardly from the cover plate so that it can be grasped and manually manipulated to move the rotary plate between positions in which the slot 174 therein is aligned with the slot 172 in the leg portion and a position wherein it is nonaligned with the slot 172 in the leg portion. The cover plate 178 further has a rectangular slot 184 which conforms in size and configuration to the slot 172 in the leg portion and always remains in alignment therewith.

It can, therefore, be appreciate, that when the slot 174 in the rotary plate 176 is not aligned with the slots 172 and 184 in the leg portion and the cover plate respectively, the pivot pin 160 will serve to interconnect the leg portion and foot portion of the boot in a manner such that the leg portion is movable relative to the foot portion only in a pivotal manner about the pin 160. However, by aligning the slot 174 in the rotary plate with the slots 172 and 184 in the leg portion and the cover plate respectively, the second body portion 170 of the pin 160 will be free to slide vertically within the aligned rectangular slots in each of the leg portion, the rotary plate and the cover plate so that the leg portion will be slideable vertically relative to the foot portion at the pivot joint. A retainer screw 186 is threaded into the outer most end of the second body portion 170 to retain the pin 160 in the position illustrated in FIG. 10.

It will be appreciated that by placing a pivot member 46 of the type described on either or both sides of the boot, that the leg portion of the boot can be inclined laterally relative to the foot portion by sliding movement of the pivot pin 160 within the slot 172 in the leg portion of the boot. This of course makes walking with the boot over uneven terrain much easier and less tiring on the user of the boot.

Figure 4:
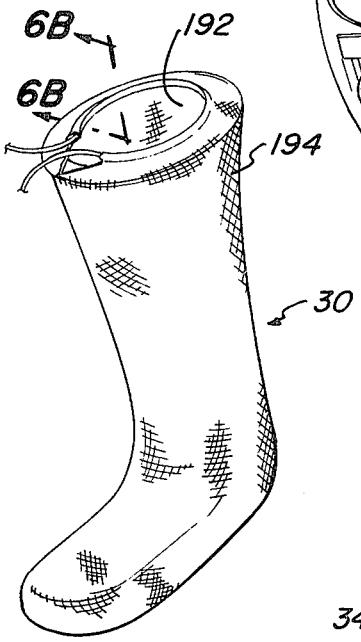
FIG. 4 is a perspective view of the sock portion of the boot of FIG. 1.
Figure 6A:
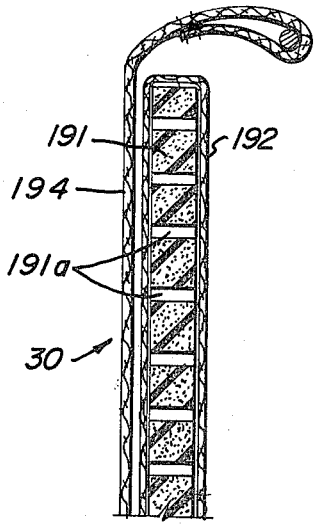
FIG. 6A is an enlarged fragmentary section taken through the sock of FIG. 4 illustrating two embodiments of the core of the sock.
Figure 6B:
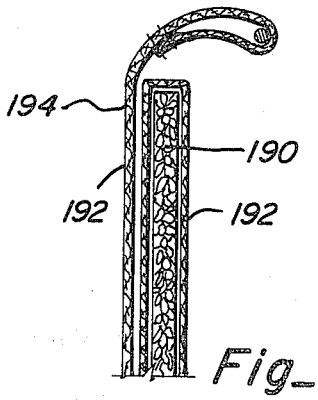
FIG. 6B is a section taken along line 6B6B of FIG. 4.

The sock 30 of the boot, which as mentioned previously is removable from the outer shell 22, has been designed to make the boot comfortable on the user and to also insulate the user's foot and lower leg for warmth during use. The preferred form of the sock, as best illustrated in FIGS. 4 and 6B has a core 190 of reticulated plastic material, such as of the type manufactured by Scott Paper Co. under the name Scott Industrial Foam PVC/SIF or Scott Industrial Foam SRX/SIF. The core is preferably 100% reticulated for best insulating, ventilation and cushioning results. As an alternative to the reticulated core of FIG. 6B, a core 191 could be made of a closed or open cell plastic foam with perforation 191*a* therethrough as illustrated in FIG. 6A. The core 190 or 191 is shaped to conform to the foot and lower leg portion of a user and is retained in a pouch 192 preferably made of a woven mesh fabric of polyester or the like. The pouch, of course, is also shaped to conform to the foot and lower leg portion of a user and is in face to face relationship with the core on both faces of the core. The smooth woven mesh fabric of the pouch 192 defines the inner surface of the sock 30 so that the foot of a user can be easily slid into the sock without disrupting its configuration. The pouch 192 is retained within an outer covering 194, preferably of water repellant nylon, or the like, which also has a smooth surface so that the entire sock can be easily slid into the outer shell 22 of the boot. The water repellant nature of the outer covering helps to prevent ingress of snow, water and dirt while permitting egress of water vapor and thus keeps the foot extremely warm and dry.

Preferably, the outer covering 194 is removable from the remainder of the sock so that outer coverings of various colors can be utilized and also so that a wet outer covering can be replaced for a dry one when desired. In the disclosed form, the outer covering, which also conforms to the configuration of the foot and lower leg portion of a user, has elastic 196 around the open upper end thereof so that it will normally be retained upon the remainder of the sock but can be removed therefrom by stretching the elastic band at the top and pulling the remainder of the sock out of the outer covering.

It will be appreciated that a new and improved ski boot as has been described which is versatile so as to be useful for both alpine and cross country skiing and can be readily changed between modes for use in either type of skiing. Further, since the connection unit at the rear of the boot can be removed during cross country skiing, it makes the boot lighter and thus less tiring for the user.

Although the present invention has been described with a certain degree of particularity, it is understood that the present disclosure has been made by way of example and that changes in details of structure may be made without departing from the spirit thereof.

What is claimed is:

1. A ski boot comprising in combination:

an upper having a foot portion and leg portion, said leg portion adapted to extend along the calf portion of a user's leg.

pivot means interconnecting the foot portion to the leg portion whereby the leg portion is pivotal about a generally horizontal axis passing transversely of the foot portion, a connection unit interconnecting the foot portion and leg portion, said connection unit having double acting resilient means therein for cushioning both forward and rearward pivotal movement of the leg portion relative to the foot portion and, a removable sock portion adapted to be slid into and out of the upper, said sock portion having a water-repellant outer covering and a core of at least partially reticulated plastic material.

2. The ski boot of claim 1 wherein said connecting unit has a slide rod anchored to one of said foot portion and leg portion and a sleeve slidably receiving said rod anchored to the other of said foot portion and leg portion, and a pair of compression springs positioned on said rod on opposite sides of said sleeve adapted to yieldingly resist axial movement of said rod relative to said sleeve.

3. The ski boot of claim 2 wherein said compression springs are retained on said rod by axially adjustable members adapted to selectively adjust the yielding resistance of said springs.

4. The ski boot of claim 1 wherein said connecting unit has a slide rod anchored to one of said foot portion and leg portion and an elongated housing slidably receiving said rod anchored to the other of said foot portion and leg portion, said rod having a collar fixed thereon and a pair of compression springs on opposite sides of the collar retained in the housing such that axial movement of the rod within the housing will be yieldingly resisted by the springs.

5. The ski boot of claim 4 wherein the housing defines a sealed chamber and wherein said collar has a flow passage therethrough and an outer configuration conforming to the cross-sectional configuration of the chamber, and further including seal means establishing a sliding seal movement of said collar within said chamber is pneumatically buffered.

6. The ski boot of claim 1 wherein said connecting unit has a slide rod anchored to one of said foot portion and leg portion and an elongated housing slidably receiving said rod anchored to the other of said foot portion and leg portion, said housing having a compression spring therein and said rod having a pair of collars fixed thereon at axially spaced positions adapted to operatively engage opposite ends of the spring whereby the spring yieldingly resists axial movement of the rod relative to the housing.

7. A ski boot comprising in combination:

an upper having a foot portion and a leg portion, said leg portion adapted to extend along the calf portion of a user's leg, pivot means interconnecting the foot portion to the leg portion whereby the leg portion is pivotal about a generally horizontal axis passing transversly of the foot portion, and a removable sock portion adapted to be slid into and out of the upper, said sock portion having a water-repellant outer covering and a core of at least partially reticulated plastic material.

8. The ski boot of claim 7 wherein said plastic material is 100% reticulated.

9. The ski boot of claim 7 wherein said outer covering is removable from said core.

10. The ski boot of claim 8 wherein said core is retained between layers of flexible fabric material which define a confining enclosure for the core.

11. The ski boot of claim 10 wherein said outer cover is a nylon material.

12. A ski boot comprising in combination:

an upper having a foot portion and a leg portion, said leg portion adapted to extend along the calf portion of a user's leg, pivot means interconnecting the foot portion to the leg portion whereby the leg portion is pivotal about a generally horizontal axis passing transversely of the foot portion, a removable connection unit interconnecting the foot portion and leg portion, said connection unit having resilient means therein for cushioning relative pivotal movement of the leg portion and the foot portion, and quick release means removably connecting the connection unit to the upper whereby said connection unit can be easily removed as a unit allowing free pivotal movement of the leg portion relative to the foot portion within predetermined limits.

13. A ski boot comprising in combination:

an upper having a foot portion and a leg portion made of a semi-rigid material with limited flexibility, said leg portion adapted to extend along the calf portion of a user's leg, pivot means interconnecting said foot portion and leg portion on opposite sides thereof to allow relative pivotal movement of the foot portion and leg portion about a generally horizontal axis passing transversely of the foot portion, and sliding movement means on at least one side of said upper for selectively allowing relative sliding movement of the leg portion and foot portion in a generally vertical direction independently of the pivotal movement of the leg portion and foot portion.

14. The ski boot of claim 13 wherein said pivot means includes a pivot pin and said sliding movement means includes a slot in one of said foot portion and leg portion, said slot slidably receiving said pivot pin.

15. The ski boot of claim 14 wherein said pivot means further includes a rotatable plate member having a slot therein which can be aligned with said first mentioned slot to permit relative sliding movement of the foot and leg portions and which can be moved out of alignment with said first mentioned slot to prevent sliding movement of the foot and leg portions.

16. The ski boot of claim 15 wherein said plate member is rotatably supported in a cover member anchored to the one of said foot portion and leg portion which has the first mentioned slot to prevent sliding movement of the foot and leg portion which has the first mentioned slot therein and wherein said plate member has a handle portion projecting through said cover member to facilitate rotation of the plate member.

17. The ski boot of claim 13 wherein there are a pair of said pivot means, one on each side of said boot and wherein said pivot means includes a pivot pin projecting through an opening in one side of said foot portion and through a generally vertically oriented elongated slot in the corresponding sides of said leg portion, said slot being aligned with said opening, a rotary plate pivotally mounted upon said pivot pin and having a slot therein which can be moved into and out of parallel relationship with said first mentioned slot, and a cover plate anchored to said leg portion and rotatably supporting said rotary plate, having a handle projecting through said arcuate opening whereby said rotary plate can be oriented such that the slot therein is in parallel relationship with the associated slot in said leg portion to allow the leg portion to slide in a generally vertical direction relative to the foot portion at the pivotal connection of the leg portion to the foot portion.

18. A ski boot comprising in combination:

an upper having a foot portion and a leg portion, said leg portion adapted to extend along the calf portion of a use's leg, pivotal means interconnecting the foot portion to the leg portion whereby the leg portion is pivotal about a generally horizontal axis passing transversely of the foot portion, and a connection unit interconnecting the foot portion and leg portion, said connection unit having a slide rod anchored to one of said foot portion and leg portion and an elongated housing slideably receiving said rod anchored to the other of said foot portion and leg portion, said housing having a continuous resilient member therein and said rod having a pair of collar means fixed thereon at axially spaced positions adapted to operatively engage opposite ends of the resilient member whereby the entire continuous extent of the resilient member yieldingly resists axial movement of the rod relative to the housing.

19. The ski boot of claim 18 further including means for quickly releasing the connection unit from the ski boot.

* * * * *